US006747559B2

(12) United States Patent
Antonenco et al.

(10) Patent No.: US 6,747,559 B2
(45) **Date of Patent: *Jun. 8, 2004**

(54) GLASS-COATED AMORPHOUS MAGNETIC MIRCOWIRE MARKER FOR ARTICLE SURVEILLANCE

(75) Inventors: Alexandru Antonenco, Kishinev (MD); Edward Brook-Levinson, Petah Tikva (IL); Vladimir Manov, Haifa (IL); Evgeni Sorkine, Tel Aviv (IL); Yuri Tarakanov, Haifa (IL)

(73) Assignee: Advanced Coding Systems Ltd., Even Yehuda (IL)

( * ) Notice: Subject to any disclaimer, the term of this patent is extended or adjusted under 35 U.S.C. 154(b) by 0 days.

This patent is subject to a terminal disclaimer.

(21) Appl. No.: 10/227,541

(22) Filed: Aug. 26, 2002

(65) Prior Publication Data

US 2003/0085809 A1 May 8, 2003

Related U.S. Application Data

(63) Continuation-in-part of application No. 09/658,868, filed on Sep. 8, 2000, now Pat. No. 6,441,737.

(30) Foreign Application Priority Data

Sep. 10, 1999 (IL) ..... 131866

(51) Int. Cl.[7] ..... G08B 13/14

(52) U.S. Cl. ..... 340/572.1; 340/551; 148/300; 148/304

(58) Field of Search ..... 340/572.1, 551, 340/572.6; 148/300, 304, 306, 307, 313; 235/449, 462.01; 428/611

(56) References Cited

U.S. PATENT DOCUMENTS 4,484,184 A 11/1984 Gregor et al.
4,945,339 A * 7/1990 Yamauchi et al. ..... 340/551

(List continued on next page.)

FOREIGN PATENT DOCUMENTS

| | | |
|---|---|---|
| EP | 0 316 811 | 5/1989 |
| WO | WO 97/24734 A1 | 7/1997 |
| WO | WO 98 20467 | 5/1998 |

OTHER PUBLICATIONS

Antonenko et al., "High Frequency properties of glass–coated microwire", *Journal of Applied Physics*, (1998), vol. 83, No. 11, pp. 6587–6589.

(List continued on next page.)

*Primary Examiner*—Anh V. La
(74) *Attorney, Agent, or Firm*—Browdy and Neimark, P.L.L.C.

(57) ABSTRACT

A magnetic marker for use in an article surveillance system, and an electronic article surveillance system utilizing the same are presented. The marker comprises a magnetic element including a predetermined number of microwire pieces made of an amorphous metal-containing material coated with glass and having substantially zero magnetostriction, coercivity substantially less than 10 A/m, and permeability substantially higher than 20000, the predetermined number of the microwire pieces and a core diameter of the microwire piece being selected in accordance with a desired detection probability of the marker to be obtained in a specific detection system.

29 Claims, 3 Drawing Sheets

U.S. PATENT DOCUMENTS

| | | | | | |
|---|---|---|---|---|---|
| 4,946,746 | A | * | 8/1990 | Ichiryu et al. | 428/606 |
| 5,001,018 | A | | 3/1991 | Takada | |
| 5,519,379 | A | | 5/1996 | Ho et al. | |
| 5,801,630 | A | | 9/1998 | Ho et al. | |
| 6,229,445 | B1 | | 5/2001 | Wack | |
| 6,232,879 | B1 | * | 5/2001 | Tyren | 340/572.6 |
| 6,270,591 | B2 | | 8/2001 | Chiriac | |
| 6,441,737 | B1 | * | 8/2002 | Antonenco et al. | 340/572.1 |
| 6,556,139 | B2 | * | 4/2003 | Manov et al. | 340/572.6 |

OTHER PUBLICATIONS

Donald et al., "The preparation, properties and applications of some glass–coated filaments prepared by the Taylor–wire process", *Journal of Materials Science*, (1996) vol. 31, pp. 1139–1149.

Wiesner et al., "Magnetic Properties of Amorphous Fe–P Alloys Containing Ga, Ge and As", *Physica Status Solidi*, (1974), vol. 26, No. 71, pp. 71–75.

* cited by examiner

GLASS-COATED AMORPHOUS MAGNETIC MIRCOWIRE MARKER FOR ARTICLE SURVEILLANCE

This is a continuation-in-part of parent application Ser. No. 09/658,868, filed Sep. 8, 2000 now U.S. Pat. No. 5,441,737.

FIELD OF THE INVENTION

The present invention is in the field of article surveillance techniques and relates to a magnetic marker for use in an electronic article surveillance system (EAS).

BACKGROUND OF THE INVENTION

Magnetic markers are widely used in EAS systems, due to their property to provide a unique non-linear response to an interrogating magnetic field created in a surveillance zone. The most popularly used markers utilize a magnetic element made of soft magnetic amorphous alloy ribbons, which is typically shaped like an elongated strip. A marker of this kind is disclosed, for example, in U.S. Pat. No. 4,484,184. This strip-like marker usually is of several centimeters in length and a few millimeters (or even less than a millimeter) in width.

It is a common goal of marker designing techniques to decrease the marker dimensions and to enhance the uniqueness of its response. One of the important parameters of a marker is its detection probability determined, for example in EAS systems of Meto International GmbH, as a minimal angle of inclination of the marker from the central vertical plane of an interrogation zone at which the marker is detectable. The interrogation zone is typically a space between detection coils, i.e., a magnetic detection system capable of identifying the existence of a magnetic marker on an item passing through the gate. Another important parameter of a marker is its length. It is known that the longer the magnetic element of the marker, the less the sensitivity value of the system, which is sufficient for the detection of the marker-associated article. Moreover, the conventional attaching device, known as the so-called "tagging gun", is capable of automatically attaching markers of up to 32 mm in length to various items. Longer markers have to be attached manually. For example, the conventional 32 mm-length marker (made from amorphous ribbon) commercially available from Meto International GmbH has the minimal detection angle (the so-called "Meto angle") of about 30–35°, at an aisle width of 90 cm. Additionally, it is desirable to increase the marker flexibility so as to enable its attachment to various flexible and flat articles like clothes, footwear, etc. in a concealed manner. For these purposes, a magnetic element in the form of a thin wire is preferable over that of a strip.

U.S. Pat. No. 5,801,630 discloses a method for preparing a magnetic material with a highly specific magnetic signature, namely with a magnetic hysteresis loop having large Barkhausen discontinuity at low coercivity values, and a marker utilizing a magnetic element made of this material. The material is prepared from a negative-magnetostrictive metal alloy by casting an amorphous metal wire, processing the wire to form longitudinal compressive stress in the wire, and annealing the processed wire to relieve some of the longitudinal compressive stress. However, a relatively large diameter of the so-obtained wire (approximately 50 $\mu$m) impedes its use in EAS applications. Additionally, a complicated multi-stage process is used in the manufacture of this wire. Furthermore, amorphous wire brittleness unavoidably occurs, due to the wire-annealing process. Such brittleness will prevent the use of the wire in flexible markers.

A technique for manufacturing microwires known as Taylor-wire method enables to produce microwires having very small diameters ranging from one micrometer to several tens of micrometers by a single-stage process consisting of a direct cast of a material from melt. Microwires produced by this technique may be made from a variety of magnetic and non-magnetic alloys and pure metals. This technique is disclosed, for example, in the article "*The Preparation, Properties and Applications of Some Glass Coated Metal Filaments Prepared by the Taylor-Wire Process*", W. Donald et al., Journal of Materials Science, 31, 1996, pp. 1139–1148.

The most important feature of the Taylor-wire process is that it enables to produce metals and alloys in the form of a glass-coated microwire in a single operation, thus offering an intrinsically inexpensive way for the microwire manufacture.

A technique of manufacturing magnetic glass-coated microwires with an amorphous metal structure is described, for example, in the article of *"Magnetic Properties of Amorphous Fe—P Alloys Containing Ga, Ge, and As", H. Wiesner and J. Schneider, Phys. Stat. Sol. (a)* 26, 71 (1974).

The properties of amorphous magnetic glass-coated microwires are described in the article "High Frequency Properties of Glass-Coated Microwires", A. N. Antonenko et al, Journal of Applied Physics, vol. 83, pp. 6587–6589. The microwires cast from alloys with small negative magnetostriction demonstrate flat hysteresis loops with zero coercivity and excellent high frequency properties. The microwires cast from alloys with positive magnetostriction are characterized by ideal square hysteresis loops corresponding to their single-domain structure.

SUMMARY OF THE INVENTION

There is a need in the art to facilitate the article surveillance by providing a novel magnetic marker to be used in EAS system.

It is a major feature of the present invention to provide such a marker that has minimum dimensions, while maintaining the necessary level of response to an interrogating magnetic field.

It is a further feature of the present invention that the marker has highly unique response characteristics.

It is a still further feature of the present invention that the marker is extremely flexible, and can therefore be introduced to articles made of fabrics and having a complex shape.

The main idea of the present invention is based on the use of amorphous metal glass-coated magnetic microwires with substantially zero magnetostriction, very low coercivity (substantially less than 10 A/m) and high permeability (substantially higher than 20000) to form a magnetic element of a marker. The present invention takes advantage of the use of the known Tailor-wire method for manufacturing these amorphous glass-coated magnetic microwires from materials enabling to obtain the zero magnetostriction.

Although amorphous magnetic glass-coated microwires and their manufacture have been known for a long time, no attempts were made for using them in magnetic elements of EAS markers. These amorphous magnetic glass-coated microwires, however, have good mechanical strength, flexibility, and corrosion resistance, and can therefore be easily incorporated in paper, plastic, fabrics and other article materials.

The inventors have found that the use of the Tailor-wire method allows for obtaining thin glass-coated amorphous microwire (with the core diameter of about 30 μm and less), and that the properties of the microwire can be controlled by varying the core diameter value, as well as varying the metal-containing composition to meet the above-indicated magnetostriction, coercivity and permeability conditions. The glass-to-metal ratio is also controlled, such that the glass-coating thickness is about 1–5 μm the 45–60 μm core diameter wire, and preferably 1–3 μm for 30 μm core diameter wire.

Additionally, the inventors have found that, in the detection system of Meto International GmbH (for example, the Meto 2200/EM3+ model), a 32 mm-length marker formed from three 30 μm core diameter microwires renders a 22–250° detection probability at an aisle width of 90 cm, and that a single-microwire marker with the 45–60 μm core diameter (preferably 50 μm) microwire renders a detection probability of about 17–20°. The same 17–20° detection probability can be obtained with a marker formed from an array (e.g., bundle) of five 30 μm core diameter microwires. Moreover, a 50 μm core diameter microwire with a 26 mm length renders the detection probability of about 18–22° (with the detection systems of Meto International GmbH), where ribbon-based markers of this length do not work at all.

The term "detection probability" used herein signifies a minimal angle of inclination of the marker from the central vertical plane of an interrogation zone defined by a detection system, at which the marker is detectable by the system.

There is thus provided according to one aspect of the present invention, a magnetic marker for use in an electronic article surveillance (EAS) system, the marker comprising a magnetic element including a predetermined number of microwire pieces made of an amorphous metal-containing material with glass coating and having substantially zero magnetostriction, coercivity substantially less than 10 A/m and permeability substantially higher than 20000, said predetermined number of the microwire pieces and a core diameter of the microwire piece being selected in accordance with a desired detection probability of the marker to be obtained in a specific detection system.

The marker may contain the single microwire piece with the above magnetic properties and a core diameter substantially within a range of 45–60 μm, or at least three microwire pieces, each with the above magnetic properties and the core diameter substantially not exceeding 30 μm. These markers are characterized by the detection probability substantially not exceeding 25° (more specifically 17–25°) at the aisle width of 90 cm in the detection systems of Meto International GmbH (specifically, the Meto 2200/EM3+gates model).

The microwire preferably has a length substantially not exceeding 32 mm (e.g., 26–32 mm length), and can therefore be easily attached to an item (i.e., by the conventional tagging gun.

According to another aspect of the present invention, there is provided a magnetic marker for use in an electronic article surveillance (EAS) system, the marker comprising a magnetic element having a single microwire piece, which is made of an amorphous metal-containing material with glass coating and has substantially zero magnetostriction, coercivity substantially less than 10 A/m and permeability substantially higher than 20000, a core diameter of the microwire piece being of about 45–60 μm.

According to yet another aspect of the present invention, there is provided a magnetic marker for use in an electronic article surveillance (EAS) system, the marker comprising a magnetic element including at least three microwire pieces, each of the microwire pieces being made of an amorphous metal-containing material with glass coating and having substantially zero magnetostriction, coercivity substantially less than 10 A/m and permeability substantially higher than 20000, a core diameter of the microwire piece substantially not exceeding 30 μm.

Preferably, the microwire piece is manufactured by a single-stage process of direct cast from melt (i.e., Tailor-wire method). The properties of the microwire piece are controlled by varying the metal-containing material composition and the glass-to-metal diameter ratio.

As indicated above, the microwire piece comprises a core, made of the metal-containing material, and the glass coating. The metal core and the glass coating may be either in continuous contact or may have only several spatially separated points of contact.

Preferably, the metal containing material is a cobalt-based alloy. For example Co—Fe—Si—B alloy (e.g., containing 77.5% Co, 4.5% Fe, 12% Si, and 6% B by atomic percentage), Co—Fe—Si—B—Cr alloy (e.g., containing 68.7% Co, 3.8% Fe, 12.3% Si, 11.4% B, and 3.8% Cr by atomic percentage), or Co—Fe—Si—B—Cr—Mo alloy (e.g., containing 68.6% Co, 4.2% Fe, 12.6% Si, 11% B, 3.52% Cr and 0.08% Mo by atomic percentage) may be used. The microwire piece made of the Co—Fe—Si—B—Cr—Mo alloy shows less sensitivity to external mechanical tensions, due to the fact that in this microwire the metal core and glass coating are physically attached to each other only in several spatially separated points of contact, rather than being in continuous contact.

Preferably, for making a single-microwire marker (with a 45–60 μm core diameter), the cobalt-based alloy of Co, Fe, Si, B, Cr and Mo is used, e.g., the following composition: 68.6% Co, 4.2% Fe, 12.6% Si, 11% B, 3.52% Cr and 0.08% Mo by atomic percentage.

According to yet another aspect of the present invention, there is provided an electronic article surveillance system utilizing a marker mounted within an article to be detected by the system when entering an interrogation zone, the system comprising a frequency generator coupled to a coil for producing an alternating magnetic field within said interrogation zone, a magnetic field receiving coil, a signal processing unit, and an alarm device, wherein said marker comprises a magnetic element including a predetermined number of microwire pieces, made of an amorphous metal-containing material with glass coating and having substantially zero magnetostriction, coercivity substantially less than 10 A/m and permeability substantially higher than 20000, wherein the marker has one of the following designs:

- it has the single microwire piece with a core diameter of about 45–60 μm; and
- it has at least three microwire pieces, each with a core diameter substantially not exceeding 30 μm.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DETAILED DESCRIPTION OF THE PREFERRED EMBODIMENTS

Figure 1:
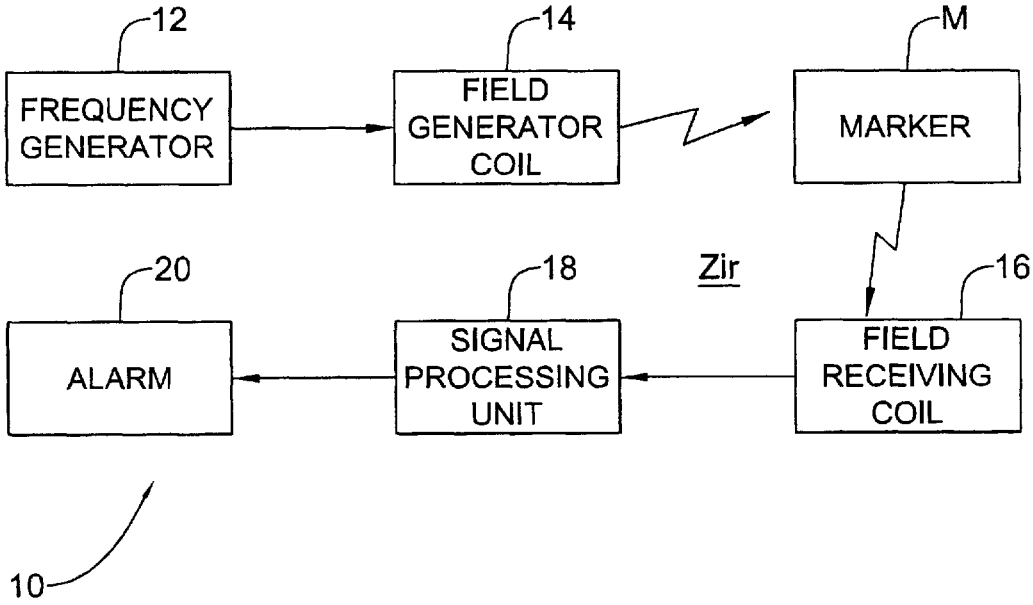
FIG. 1 is a schematic block diagram of a conventional EAS system.

Referring to FIG. 1, a block diagram of the main components typically included in an EAS system 10 is illustrated (e.g., the Meto 2200/EM3+model commercially available from Meto International GmbH). The system 10 comprises a frequency generator block 12, a coil 14 producing an alternating magnetic field within an interrogation zone $Z_{in}$, a field receiving coil 16, a signal processing unit 18, and an alarm device 20.

The system 10 operates in the following manner. When an article carrying a magnetic marker M enters the interrogation zone $Z_{in}$, the non-linear response of the marker to the interrogating field produces perturbations to the signal received by the field receiving coil 16. These perturbations, which may for example be higher harmonics of the interrogation field signal, are detected by the signal processing unit 18, which generates an output signal that activates the alarm device 20.

Figure 2A:
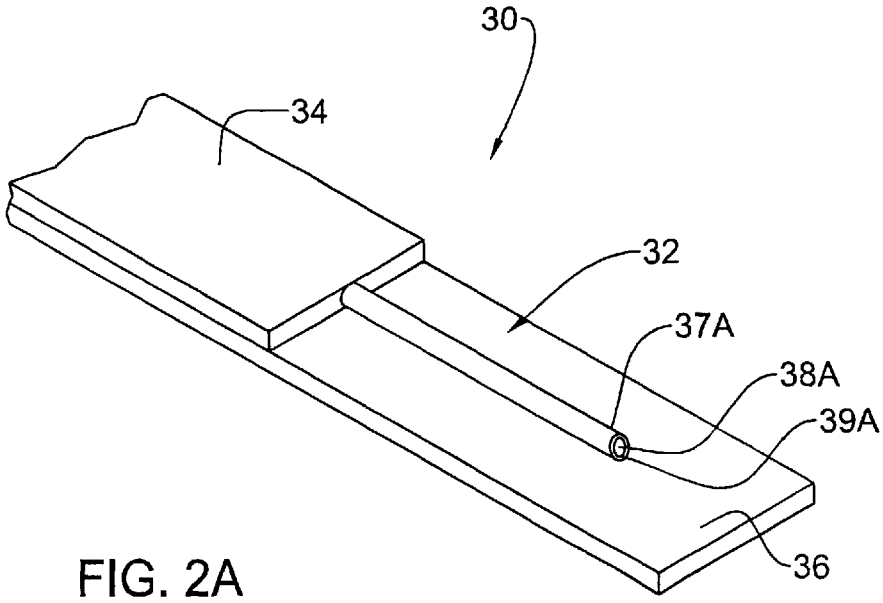
FIGS. 2A–2C schematically illustrate three examples, respectively, of a magnetic marker according to the invention.
Figure 2B:
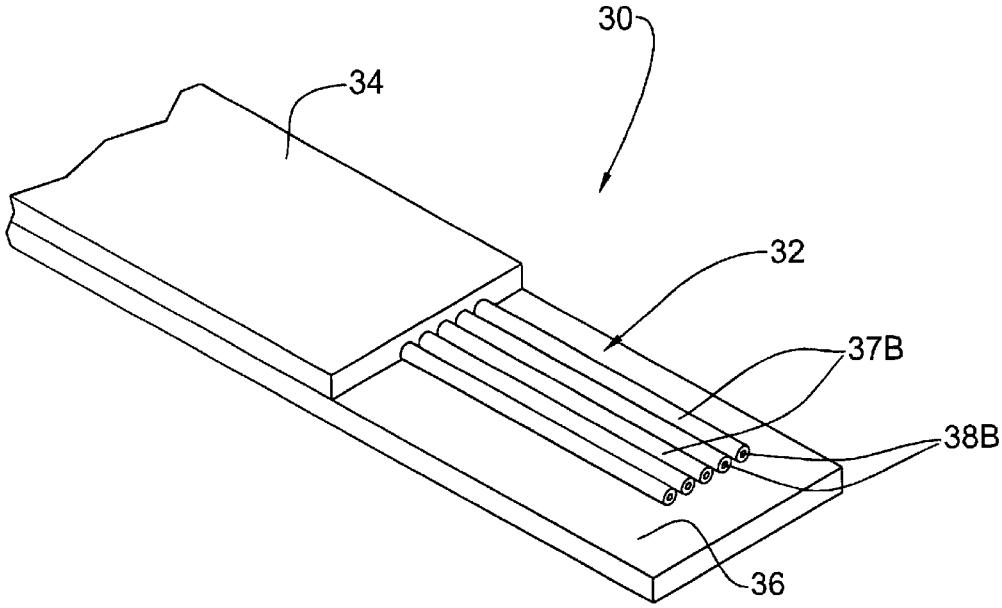
Figure 2C:
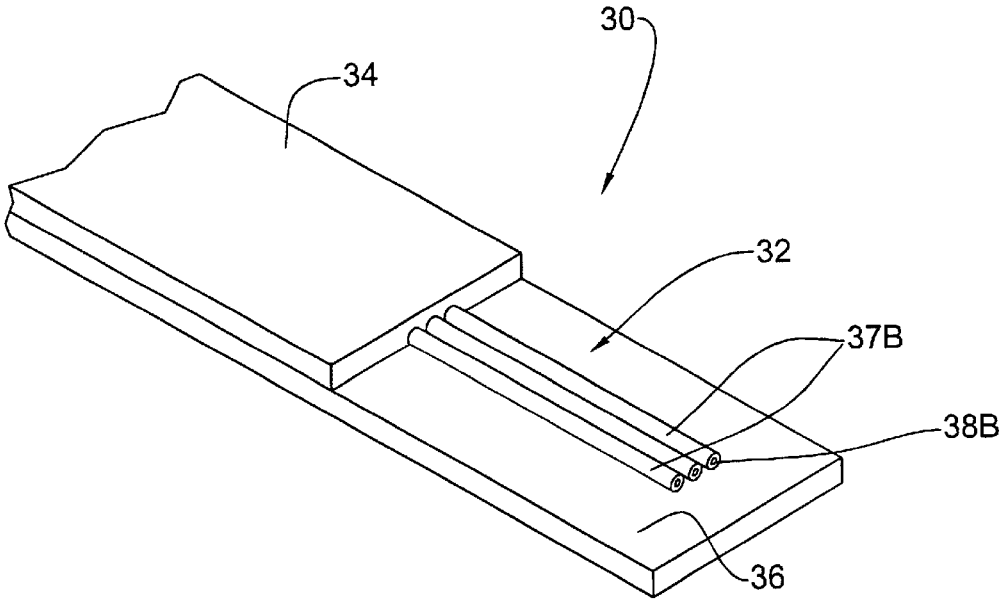

Reference is now made to FIGS. 2A–2C, illustrating three examples, respectively, of a magnetic marker 30 according to the invention suitable to be used in the system 10. To facilitate understanding, the same reference numbers are used for identifying common components in all the examples. The marker 30 includes a magnetic element 32 sandwiched between a substrate layer 34 and a cover layer 36. The outer surface of the substrate 34 may be formed with a suitable adhesive coating to secure the marker 30 to an article (not shown) which is to be monitored. A barcode label or the like may be printed on the outer surface of the cover layer 36. The substrate and cover layers 34 and 36 may be manufactured by the known co-extrusion process. This enables to produce the marker 30 with the width of few tenths of millimeters, which is very convenient for hiding it inside the article to be maintained under surveillance.

The magnetic element 32 may utilize a single microwire piece (FIG. 2A) or several (FIGS. 2B and 2C) microwire pieces. The microwire piece is made of an amorphous metal-containing material coated with glass, and is characterized by zero magnetostriction, coercivity substantially less than 10 A/m, and permeability substantially higher than 20000.

In the example of FIG. 2A, the magnetic element 32 is formed by a single microwire piece 37A which has an amorphous metal-containing core 38A and a glass coating 39A. The microwire 37A has the length of about 32 mm and the core diameter of about 50 $\mu$m. This marker is characterized by a 17–20° detection probability in the system 10 (Meto 2200/EM3+gates) at an aisle width of 90 cm. Such a single-microwire based marker with the 50 $\mu$m core diameter and a 26 mm length has shown the detection probability of 18–22°.

A detection probability of 17–20° is also obtainable with the marker of FIG. 2B, whose magnetic element 32 is formed by five magnetic amorphous glass-coated microwire pieces, generally at 37B, each having a length of about 32 mm and a diameter of a core 38B of about 30 $\mu$m. In the marker of FIG. 2C, the magnetic element 32 is formed of three such microwires 37B (32 mm length and 30 $\mu$m core diameter), and shows the detection probability of 22–25° in the Meto 2200/EM3+gates detection system.

The glass-coated magnetic microwire piece is manufactured by utilizing a direct cast from the melt technique, known as Taylor-wire method. The so-prepared glass-coated magnetic microwire piece is characterized by low coercivity (substantially less than 10 A/m) and high permeability values (substantially higher than 20000). The inventors have found that such a microwire can be manufactured from amorphous alloys having zero magnetostriction. The hysteresis loops of this microwire may be similar to that of die-drawn amorphous wires disclosed in the above U.S. Pat. No. 5,801,630. However; according to the principles of the present invention, no additional processing is needed after the microwire casting. The microwire properties can be controlled by varying the alloy composition and the glass-to-metal diameter ratio.

Following are three examples of the microwire piece manufactured according to the invention and tested:

(1) The microwire is made of Co—Fe—Si—B—Cr—Mo alloy containing 68.6% Co, 4.2% Fe, 12.6% Si, 11% B, 3.52% Cr and 0.08% Mo by atomic percentage. This composition was used in the example of FIG. 2A. Some more features of this microwire will be described further below with reference to FIG. 4.

(2) The microwire is made of an alloy containing 77.5% Co, 4.5% Fe, 12% Si, and 6% B by atomic percentage. This microwire was used in the examples of FIGS. 2B and 2C.

(3) The microwire is made of Co—Fe—Si—B—Cr alloy containing 68.7% Co, 3.8% Fe, 12.3% Si, 11.4% B, and 3.8% Cr by atomic percentage. This microwire was used in the examples of FIGS. 2B and 2C.

Other microwire samples were tested by the inventors, the samples being manufactured from the Co—Fe—Si—B alloys generally similar to the above composition, but with small variations of the contents of iron, i.e. within ±0.05%. When utilizing a magnetic element formed of 3–5 microwires (generally, at least three), thinner microwires are used: the outer diameter of the microwire of about 22–25 $\mu$m, and the diameter of its metal core of about 16–20 $\mu$m. When utilizing a magnetic element formed of the single microwire, the microwire with the core diameter of about 45–60 $\mu$m is used (specifically suitable for use with the Meto 2200/EM3+ gates detection system).

The above detection probability of the markers of the present invention can be partly explained by considering the observed re-magnetization curves of markers. It was discovered that for the optimum wire diameter, the hysteresis curves were practically rectangular with very small values of coercive force, less than 5 A/m. At smaller wire diameters, the coercive force value increases, and the signal amplitude falls proportionally to the metal cross section. At greater wire diameters, the coercive force increases again, and hysteresis curves get inclined due to an increase in the demagnetization factor. This inclination means a decrease in the effective permeability of the marker, and hence in the signal amplitude of the marker.

Figure 3:
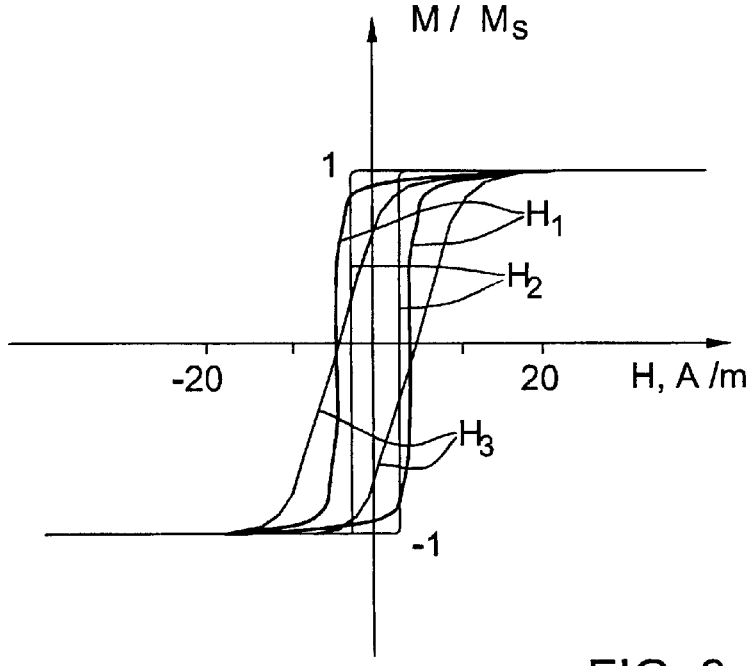
FIG. 3 graphically illustrates the main characteristic of the marker's magnetic element.

FIG. 3 illustrates the shapes of measured hysteresis curves of the microwire marker samples according to the invention. The hysteresis loop $H_1$ corresponds to the microwire with a 15–20 $\mu$m core diameter (the total diameter of the microwire sample of about 17–22 $\mu$m). The hysteresis loop $H_2$ corresponds to the 32 mm length marker comprising a single microwire with a 50 $\mu$m core diameter. The hysteresis loop $H_3$ corresponds to a 32 mm length marker but with the microwire having a 60 $\mu$m core diameter. All the hysteresis loops have a small coercivity value, namely, of less than 10 A/m, and large Barkhausen discontinuity, that is, a high permeability value (higher than 20000).

It is important to note that such ideal magnetic characteristics of the 45–60 μm (preferably 50 μm) core diameter microwire are not observed in the in-water-cast amorphous wires (see U.S. Pat. No. 5,801,630). This is because of the influence of stresses produced by the thin glass coating on the amorphous metal core that seemingly has a very small positive magnetostriction value, as well as because of internal stresses produced in the metal core during the rapid solidification process.

It should be noted that, when utilizing a magnetic element formed of several microwires, they can be twisted in a thread. Such a thread may be manufactured by the known textile methods, and may utilize non-magnetic reinforcement fibers (e.g., polyester fibers). To improve the mechanical performance of the marker, the thread may be soaked with an appropriate elastic binder. Such a thread-like magnetic element may be manufactured by arranging a plurality of non-magnetic reinforcement fibers to form a conventional sewing thread, the magnetic glass coated microwires being concealed in the plurality of fibers. This design is convenient for embedding the magnetic markers in the articles made of fabrics, e.g., clothing. Alternatively, a thread-like shaped magnetic marker may comprise a bundle of parallel, untwisted microwire pieces assembled in a thread by winding auxiliary non-magnetic fibers around the bundle. The auxiliary fibers may only partly cover the external surface of the marker, or may cover the entire external surface of the marker, so that it will look like a usual sewing thread.

It should also be noted that the mechanical performance of the marker can be improved by additionally coating the microwire pieces with plastic polymer materials, such as polyester, Nylon, etc. The coating may be applied to separate microwires and/or to the entire microwire bundle.

Figure 4:
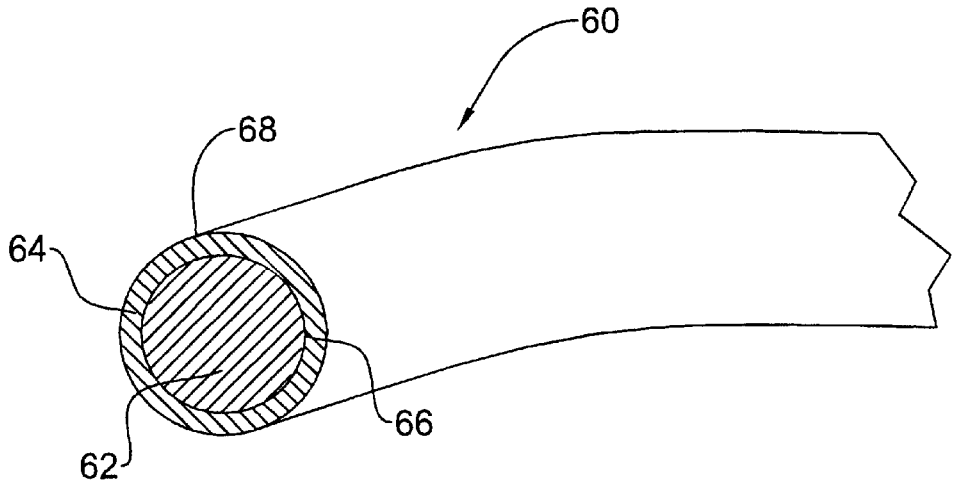
FIG. 4 illustrates more specifically some constructional principles of the microwire piece according to the invention.

FIG. 4 illustrates a microwire 60 according to the invention, composed of a metal core 62 and a glass coating 64, wherein the metal core and the glass coating are physically coupled to each other solely in several spatially separated points—one point 66 being seen in the figure. In other words, a certain gap 68 is provided between the core and the coating all along the microwire except for several points of contact.

As known, the microwire core metal may have continuous contact with the glass coat. In this case, the differences in thermal elongation of glass and metal result in considerable stresses created in the metal core 62. As disclosed in the above article by A. N. Antonenko et al., these stresses considerably affect the magnetic properties of the microwire. Additionally, the microwire is sensitive to external stresses created by its bending or twisting, which is undesirable for the purposes of the present invention, i.e., for use of the microwire in markers. It has been found by the inventors, that by controlling the conditions of a casting process, and by varying the metal alloy composition, it becomes possible to produce a microwire with separate points of contact between the metal core and the glass coating, rather than being in continuous contact. Particularly, the Co—Fe—Si—B—Cr—Mo alloy of the above example (1) was used for manufacturing the microwire 60. Microscopic analysis of the produced microwire have shown that the small gap between the metal core and glass coating take place all along the microwire except for several spatially separated points of contact. The microwire of this construction possesses less sensitivity to external mechanical tensions, as compared to that of continuous physical contact between the metal core and glass coating.

The advantages of the present invention are self-evident. The use of amorphous glass coated microwires of substantially zero magnetostriction, very low coercivity and high permeability as the magnetic element of an EAS marker, enables to produce a desirably miniature and flexible marker suitable to be attached and/or hidden in a delicate article to be monitored. Moreover, the use of the Tailor-wire method for manufacturing such microwires significantly simplifies the manufacture and provides for the desirable thickness of the microwire.

The markers according to the present invention may be deactivated by the known methods, for example, those disclosed in the above-indicated U.S. Pat. No. 4,484,184, or by crystallizing some or all of the microwire metal cores by suitable microwave radiation.

Those skilled in the art will readily appreciate that various modifications and changes can be applied to the preferred embodiment of the present invention as hereinbefore exemplified, without departing from its scope defined in and by the appended claims.

What is claimed is:

1. A magnetic marker for use in an article surveillance system, the marker comprising a magnetic element including a predetermined number of microwire pieces made of an amorphous metal-containing material coated with glass and having substantially zero magnetostriction, coercivity substantially less than 10 A/m, and permeability substantially higher than 20000, said predetermined number of the microwire pieces and a core diameter of the microwire piece being selected in accordance with a desired detection probability of the marker to be obtained in a specific detection system.

2. The marker according to claim 1, wherein the microwire piece is manufactured by a single-stage process of direct cast from melt.

3. The marker according to claim 2, wherein the properties of the microwire piece are controlled by varying the metal-containing material composition and the core diameter of the microwire.

4. The marker according to claim 1, wherein the microwire piece has a length substantially not exceeding 32 mm.

5. The marker according to claim 1, wherein the microwire piece has a length of about 26–32 mm.

6. The marker according to claim 1, wherein the magnetic element has the single microwire piece having the core diameter of about 45–60 μm.

7. The marker according to claim 1, wherein the magnetic element comprises at least three microwire pieces, each having the core diameter substantially not exceeding 30 μm.

8. The marker according to claim 1, wherein said metal containing material is a cobalt-based alloy.

9. The marker according to claim 8, wherein said cobalt-based alloy is an alloy of Co, Fe, Si, B, Cr and Mo.

10. The marker according to claim 9, wherein said cobalt-based alloy contains 68.6% Co, 4.2% Fe, 12.6% Si, 11% B, 3.52% Cr and 0.08% Mo by atomic percentage.

11. The marker according to claim 9, wherein the microwire piece comprises the core made of said metal-containing material, and the glass coating, wherein the metal core and the glass coating are physically coupled to each other in several spatially separated points.

12. The marker according to claim 9, wherein the magnetic element has the single microwire piece having the core made of said metal-containing material, and the glass coating, the diameter of the core being of about 45–60 μm.

13. The marker according to claim 12, the diameter of the core being of about 50 μm.

14. The marker according to claim 12, wherein the microwire piece has a length of about 26–32 mm.

15. The marker according to claim 8, wherein said cobalt-based alloy is an alloy of Co, Fe, Si and B.

16. The marker according to claim 15, wherein said cobalt-based alloy contains 77.5% Co, 4.5% Fe, 12% Si, and 6% B by atomic percentage.

17. The marker according to claim 8, wherein said cobalt-based alloy is an alloy of Co, Fe, Si, B and Cr.

18. The marker according to claim 17, wherein said cobalt-based alloy contains 68.7% Co, 3.8% Fe, 12.3% Si, 11.4% B, and 3.8% Cr by atomic percentage.

19. The marker according to claim 15, wherein microwire piece has the core diameter substantially not exceeding 30 $\mu$m.

20. The marker according to claim 19, wherein said magnetic element comprises at least three microwire pieces.

21. The marker according to claim 15, wherein the microwire piece has a length of about 26–32 mm.

22. The marker according to claim 17, wherein microwire piece has the core diameter substantially not exceeding 30 $\mu$m.

23. The marker according to claim 22, wherein said magnetic element comprises at least three microwire pieces.

24. The marker according to claim 17, wherein the microwire piece has a length of about 26–32 mm.

25. The marker according to claim 1, wherein said magnetic element is accommodated between substrate and cover layers.

26. The marker according to claim 25, where said substrate and cover layers are manufactured by a co-extrusion process.

27. A magnetic marker for use in electronic article surveillance (EAS) system, the marker comprising a magnetic element having a single microwire piece, which is made of an amorphous metal-containing material with glass coating and has substantially zero magnetostriction, coercivity substantially less than 10 A/m and permeability substantially higher than 20000, a core diameter of the microwire piece being of about 45–60 $\mu$m.

28. A magnetic marker for use in electronic article surveillance (EAS) system, the marker comprising a magnetic element including at least three microwire pieces, each of the microwire pieces being made of an amorphous metal-containing material with glass coating and having substantially zero magnetostriction, coercivity substantially less than 10 A/m and permeability substantially higher than 20000, a core diameter of the microwire piece substantially not exceeding 30 $\mu$m.

29. An electronic article surveillance system utilizing a marker mounted within an article to be detected by the system when entering an interrogation zone, the system comprising a frequency generator coupled to a coil for producing an alternating magnetic field within said interrogation zone, a magnetic field receiving coil, a signal processing unit and an alarm device, wherein said marker comprises a magnetic element comprising a predetermined number of microwire pieces made of an amorphous metal-containing material with glass coating and having substantially zero magnetostriction, coercivity substantially less than 10 A/m and permeability substantially higher than 20000, wherein the marker has one of the following designs:

it has the single microwire piece with the core diameter of about 45–60 $\mu$m; and it has at least three microwire pieces each with the core diameter substantially not exceeding 30 $\mu$m.

* * * * *